US005421294A

United States Patent [19]

Ruoff et al.

[11] Patent Number: 5,421,294

[45] Date of Patent: Jun. 6, 1995

[54] HYDRAULIC SETTING DEVICE

[75] Inventors: Manfred Ruoff, Moeglingen; Helmut Rembold, Stuttgart; Berthold Pfuhl, Markgroeningen; Volkmar Leutner, Friolzheim; Martin Mueller, Moeglingen, all of Germany

[73] Assignee: Robert Bosch GmbH, Stuttgart, Germany

[21] Appl. No.: 204,143

[22] PCT Filed: Jul. 30, 1992

[86] PCT No.: PCT/DE92/00622

§ 371 Date: Feb. 28, 1994

§ 102(e) Date: Feb. 28, 1994

[87] PCT Pub. No.: WO93/05302

PCT Pub. Date: Mar. 18, 1993

[30] Foreign Application Priority Data

Aug. 29, 1991 [DE] Germany ..... 41 28 656.1

[51] Int. Cl.[6] ..... F01L 1/34; F15B 15/17

[52] U.S. Cl. ..... 123/90.17; 91/417 R

[58] Field of Search ..... 91/417 R, 235, 321; 123/90.17

[56] References Cited

U.S. PATENT DOCUMENTS

| | | | |
|---|---|---|---|
| 2,397,395 | 3/1946 | Wiedmann | 91/417 R X |
| 2,699,102 | 1/1955 | Doyle et al. | 91/417 R X |
| 2,991,758 | 7/1961 | Pfau | 91/417 R |
| 3,012,541 | 12/1961 | Meulendyk et al. | 91/417 R X |
| 3,033,170 | 5/1962 | Norton et al. | 91/417 R X |
| 3,105,126 | 9/1963 | Peek et al. | 91/417 R X |
| 3,768,373 | 10/1973 | Divigard | 91/417 R |
| 3,902,402 | 9/1975 | Walters | 91/417 R X |
| 4,361,073 | 11/1982 | Oelrich et al. | 91/417 R X |

FOREIGN PATENT DOCUMENTS

| | | | |
|---|---|---|---|
| 3616234 | 11/1987 | Germany . | |
| 4037834 | 6/1992 | Germany . | |
| 4224653 | 1/1994 | Germany | 123/90.17 |

*Primary Examiner*—John E. Ryznic
*Attorney, Agent, or Firm*—Michael J. Striker

[57] ABSTRACT

The hydraulic setting device has a differential cylinder (11) whose annular space (14) is continually subjected to pressure by a pump (16). The pressure space (18) at the large piston surface is connected to the pump via a connection conduit (41). A conduit branch, which leads to a control valve (21), emerges from this connection conduit (41). At the other end, this control valve is in connection with a return conduit (26). The pressure in the conduit branch (19), and therefore in the pressure spaces (14, 18) of the differential cylinder, can be varied by appropriate activation of the control valve.

14 Claims, 1 Drawing Sheet

HYDRAULIC SETTING DEVICE

PRIOR ART

The invention is based on a hydraulic setting device of the generic type of the main claim. A hydraulic setting device of this type is known from the German Offenlegungsschrift 40 37 834 in which the part pressures in the pressure spaces of a differential cylinder can be varied by means of an electromagnetically actuated control valve. The part pressures in the pressure spaces are set by partial spilling of pressure medium and these part pressures are kept approximately constant by appropriate activation of the control valve. When the differential piston is in a non-transient position, the control valve is activated in such a way that the retention pressures are very much less than the adjusting pressures necessary for an adjusting motion. For this purpose, the annular surface of the differential cylinder is continually subjected to pressure medium by a pump whereas the pressure in the pressure space on the large piston surface can be varied by the electromagnetically actuated control valve. For this purpose, the control valve is configured as a 3/2-way valve and is inserted in a conduit connection between the pump and the pressure space on the large piston surface. Such a hydraulic setting device is employed, for example, in order to actuate a device for adjusting the camshaft relative to the crankshaft (German Offenlegungsschrift 36 16 234) in an internal combustion engine. In order to seal the respective pressure-carrying connection securely against the return connection in the end positions of the control valve, valve element guide gaps—which are sometimes narrow and long—are necessary in these control valves. In consequence, these control valves are sensitive to dirt under certain circumstances, i.e. the valve function can be impaired in the case of dirty pressure medium (engine oil of the internal combustion engine).

ADVANTANGES OF THE INVENTION

The hydraulic setting device according to the invention with the characterizing features of the main claim has, in contrast, the advantage that it operates with low losses when no adjusting motion of the differential piston takes place, that it is of simple construction and that the control valve's sensitivity to dirt is slight.

Further advantages of the invention and advantageous further developments are given in the subclaims and the description.

DRAWING

Two embodiment examples of the invention are explained in more detail in the following description and drawing. The latter shows one embodiment example of a hydraulic setting device in each of FIGS. 1 and 2 in a simplified representation.

DESCRIPTION OF THE EMBODIMENT EXAMPLES

Figure 1:
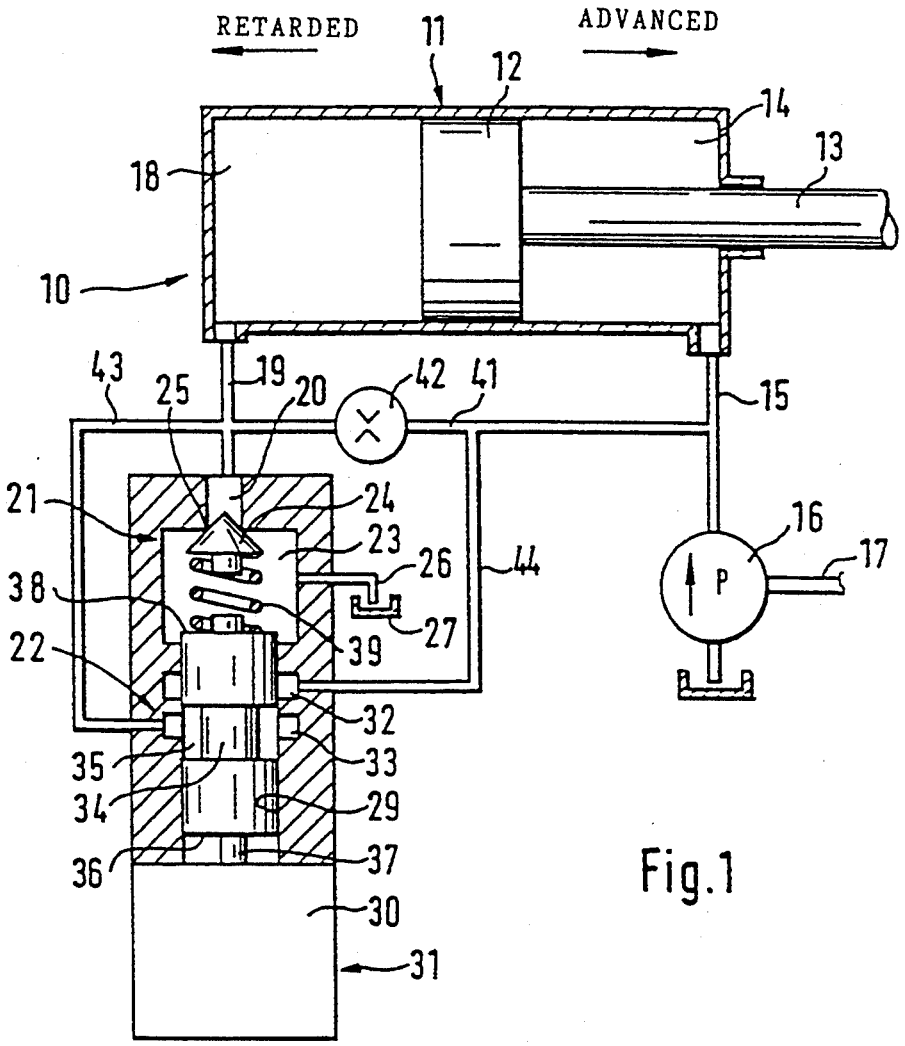

A hydraulic setting device, which has a differential cylinder 11 with a differential piston 12, 13, is indicated by 10 in FIG. 1. The pressure space 14 at the annular surface of the differential cylinder is continually subjected to pressure, via a pressure conduit 15, by a pump 16 which is driven by a drive shaft 17, of the camshaft of an internal combustion engine, for example.

The pressure space 18 on the larger effective piston surface of the differential cylinder is connected, via a conduit 19, to the input 20 of a pressure limiting valve (control valve) 21. The latter has a pressure space 23 configured in a valve housing 22, which is only indicated. A valve element 24, which interacts with a valve seat 25 on the inlet 20, is arranged in the pressure space 23. The pressure space 23 of the pressure limiting valve 21 is connected to a container 27 via a return conduit 26.

The pressure space 23 becomes a longitudinal hole 29 at its end located opposite to the valve seat 25 and this longitudinal hole 29 is closed by the housing 30 of a proportional magnet 31. Two annular control grooves 32, 33 extend, at a distance apart, around the longitudinal hole 29. A control spool 34 is arranged within the longitudinal hole 29 and this control spool 34 has, in its central region, an encircling annular groove 35 which interacts with the control grooves 32, 33 in a manner still to be explained. The actuating push-rod 37 of the proportional magnet 31 is in contact with the lower end surface 36 of the control spool 34. One end of a compression spring 39 is in contact with the upper end surface 38 and its opposite end is supported on the valve element 24.

A connecting conduit 41, which is connected via an intermediate throttle 42 to the pressure conduit 15, branches off from the pressure conduit 19. A first by-pass conduit 43 leads from the pressure conduit 19 to the lower control groove 33 in the valve housing 22. A second by-pass conduit 44 emerges from the upper control groove 32 and opens into the connecting conduit 41 between the throttle 42 and the pressure conduit 15.

The hydraulic setting device 10 is, for example, employed in a device for the continuous adjustment of the camshaft of an internal combustion engine relative to the crankshaft of the latter so that a phase shift between these two shafts is generated by this means.

The pressure limiting valve 21 actuated by the proportional magnet 31 acts as the active control element of the hydraulic setting device. In the position shown, the proportional magnet 31 is not excited, i.e. the actuation push-rod 37 and the control spool 34 are located in their lower neutral position. In consequence, only a force due to the preload on the compression spring 39 is exerted on the valve element 24 and this force presses the valve element 24 against the valve seat 25. This preload (residual load) is relatively slight, i.e. the compression spring 39 is almost completely expanded.

In this lower neutral position, the annular groove 35 of the control spool 34 is located in the region of the lower control groove 33 in the longitudinal hole 29 of the valve housing 22. The upper control groove 32 is closed off from the lower control groove 33 by the control spool 34.

The pressure space 14 of the differential cylinder 11 is directly subjected to pressure from the pump 16 via the pressure conduit 15. In order to limit the delivery flow, the induction of the pump 16 is advantageously provided with throttling. The pressure space 18 at the large piston surface of the differential piston 12 is simultaneously connected to the inlet 20 of the pressure limiting valve 21 via the pressure conduit 19. This pressure conduit 19 is also connected to the pressure conduit 15 via the connecting conduit 41 with the intermediate throttle 42. While the control spool is in the position described, the two by-pass conduits 43, 44 are respectively closed at one end by the control spool 34.

A pressure, which corresponds to the back pressure before the throttle 42 in the conduit 41, builds up in the pressure space 14 via the pressure conduit 15. At the same time, only a slight opposing pressure can build up in the pressure space 18 because of its connection to the pressure limiting valve 21 and the slight preload on the compression spring 39. When a specified opposing pressure is exceeded, the pressure limiting valve 21 opens, i.e. the valve element 24 lifts from the valve seat 25, so that there is a connection to the container 27 via the pressure space 23 and the return conduit 26. The differential piston is displaced to the left by the pressure acting in the pressure space 14.

In the device for adjusting the camshaft relative to the crankshaft, this motion of the differential piston signifies an adjustment of the camshaft to "retarded", i.e. to a retarded rotational position or retarded valve actuation.

In order to adjust to "advanced", or to an advanced rotational position, the differential piston 12, 13 must be moved to the right. For this purpose, the proportional magnet 31 is excited so that the actuating push-rod 37, and with it the control spool 34, move upwards. This increases the preload on the compression spring 39, and with it the opening pressure of the pressure limiting valve 21, so that a higher pressure can build up in the pressure space 18. Because of the displacement of the control spool 34, the control grooves 32 and 33 and the longitudinal hole 29 are, at the same time, connected via the annular groove 35 of the control spool. By this means, the throttle 42 is bypassed by the by-pass conduits 44 and 43 so that the pressure space 18 at the larger piston surface of the differential cylinder is connected to the pressure conduit 15 via the conduits 43 and 44 and the connecting conduit 41, while bypassing the throttle 42. Because of the larger effective piston surface, the differential piston 12, 13 is moved to the right. Energy losses are avoided because the throttle 42 is bypassed by means of the by-pass conduit 42, 43. In order to maintain a non-transient intermediate position of the differential piston, the pressure at the pressure limiting valve 21 is set by means of appropriate excitation (less current) of the proportional magnet 31 in such a way that the resulting force on the differential piston due to the pressures in the two pressure spaces just corresponds to the return force from the device for adjusting the camshaft. Corresponding activation of the proportional magnet likewise ensures that even in the case of changing rotational speeds of the camshaft, these retention pressures are maintained at a level which is just sufficient to accept the return forces from the device for adjusting the camshaft.

Engine emergency running even in the case of failure of the proportional magnet or of the hydraulic supply is ensured by the described configuration of the hydraulic setting device and the pressure limiting valve. On failure of the proportional magnet 31, the control spool 34 returns to its neutral position. The compression spring 39 is almost expanded at the same time so that—as previously described—the differential piston is adjusted to the left ("retarded"). On failure of the hydraulic supply, the differential piston 12, 13 is moved to the left because of the mechanical return force from the device for adjusting the camshaft. In both cases, engine emergency running is ensured because of this return to the "retarded" rotational position of the camshaft.

Long sealing gaps and narrow fits for high-pressure sealing are avoided by the use of the pressure limiting valve 21 as the active control element. In consequence, the sensitivity to dirt is slight so that the hydraulic setting device is particularly good for use in internal combustion engines with engine oil which is dirty due to operation.

Figure 2:
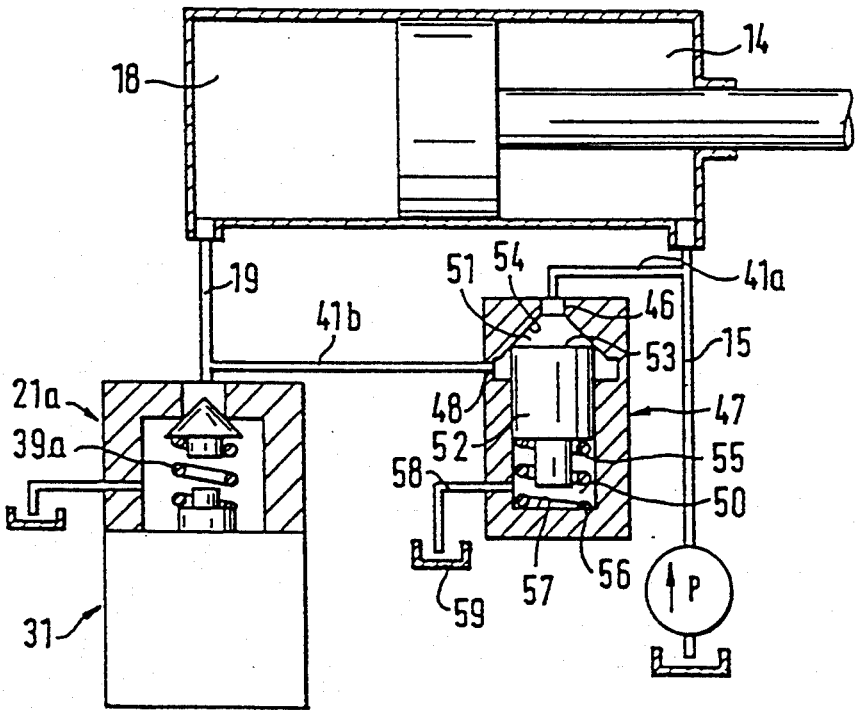

A modification of the above embodiment example, in which the throttle between the two pressure conduits is replaced by a passive pressure limiting valve, is described in FIG. 2.

In this embodiment example, the two pressure conduits 15 and 19 are connected by two connecting conduit sections **41*a*, 41*b*. The conduit section 41*a* leads from the pressure conduit 15 to the inlet 46 of the passive pressure limiting valve 47. The connecting conduit 41*b* leads from the outlet 48 of the pressure limiting valve 47 to the pressure conduit 19. The passive pressure limiting valve 47 has a cylindrical valve space 50 which opens into a conical pressure space 51. A cylindrical valve element 52 is guided in the valve space 50 and its upper end surface 53 interacts with the conical surface 54 of the pressure space. A compression spring 56 is in contact with the opposite end surface 55 and the opposite end of this compression spring 56 is in contact with the bottom 57 of the valve space. The part of the valve space accommodating the compression spring is connected to a container 59 via a leakage oil conduit 58**.

The inlet 46 of the pressure limiting valve is arranged on the pressure space in such a way that it interacts with the end surface of the valve element and the outlet is arranged underneath it in the region of the outer surface of the valve element.

In this embodiment example, the pressure limiting valve **21*a* is controlled directly by the proportional magnet 31 via the compression spring 39*a* and no control spool—such as that shown in FIG. 1—is connected between them. When no current is supplied to the proportional magnet, the pressure of approximately 30 bar necessary for adjusting the differential cylinder towards the left ("retarded") builds up in the pressure chamber 14 associated with the annular surface of the differential cylinder. The preload on the passive pressure limiting valve 47 is correspondingly set so that the pressure space 18** is practically unpressurized.

In order to adjust the differential piston towards the right ("advanced"), the preload on the compression spring **39*a* is increased by appropriate activation of the proportional magnet so that the pressure in the pressure conduit 15 and the connecting conduits 41*a*, 41*b* increases. The passive pressure limiting valve 47** then opens completely. The cross-section freed is dimensioned in such a way that there is no throttling loss worth mentioning.

In the described embodiment of the passive pressure limiting valve 47, relatively narrow fits are necessary for guiding the valve element 52 in the valve space 50 in order to seal the pressure in the pressure space 51 against the leakage oil conduit 58. In order to circumvent this disadvantage, the pressure limiting valve can also be embodied as a seat valve with a freely guided valve element. The pressure set at the control valve **21*a*** then acts on the rear (outlet end) of the valve element. A disadvantage of this second embodiment example, however, is the fact that it is continually necessary to overcome the opening pressure of the passive pressure limiting valve in order to adjust the differential piston to the right ("advanced").

In the embodiment form of the hydraulic setting device described in FIG. 2, a 2/2-way valve can also be inserted as the active control element instead of the pressure limiting valve 21*a* and this 2/2-way valve is activated in a pulsed manner by an electromagnet. The pressure control then takes place by means of open-loop or closed-loop control of the volume flow.

We claim:

1. A hydraulic setting device, comprising a differential cylinder; a differential piston reciprocatable in said cylinder and forming in the latter two pressure spaces, said differential piston having a small piston surface and a large piston surface; a pump connected with said pressure space at said large piston surface by a conduit who subjects the differential piston to pressure medium; throttle device provided in said conduit, said conduit having a conduit bypass from a conduit connection between said throttle device and said pressure space at said large piston surface; an electromagnetically actuated control valve arranged in said conduit bypass so that pressure in said conduit bypass is variable by spilling pressure medium via said control valve so that a part pressure is respectively produced in said pressure space by partial spilling of pressure medium, which part pressure is kept approximately constant by corresponding activation of said control valve so that retention pressures which are very much smaller than adjusting pressure are set in a non-transient position of said differential piston, said throttle device having a throttle cross-section changing as a function of the setting pressure of said control valve.

2. A hydraulic setting device as defined in claim 1; and further comprising a proportional magnet, said control valve being a pressure limiting valve and actuated by said proportional magnet.

3. A hydraulic setting device as defined in claim 1, wherein said throttle device has a throttle with a fixed throttle cross-section and a variable by-pass device connected in parallel with said throttle.

4. A hydraulic setting device as defined in claim 3, wherein said by-pass device has a control spool which is actuated by said proportional magnet and which interacts with two control grooves, one of said control grooves being connected to a conduit connection upstream of said throttle while the other of said control grooves being connected to a conduit connection downstream of said throttle.

5. A hydraulic setting device as defined in claim 1, wherein said control valve is an electromagnetically activated 2/2-way valve.

6. A hydraulic setting device as defined in claim 1; and further comprising a device for adjusting a cam shaft of an internal combustion engine relative to a crankshaft, said differential piston being connected with said device for adjusting the camshaft relative to the crankshaft.

7. A hydraulic setting device having a differential cylinder; a differential piston reciprocable in said differential cylinder and defining in the latter two pressure spaces, said differential piston having a small piston area and a large piston area; a pump connected with said cylinder and subjecting said differential piston to pressure medium supplied by said pump; a throttle device provided in a conduit connecting said pump with said pressure space at said large piston surface; an electromagnetically actuated control valve arranged in a conduit bypass said conduit so as to vary a pressure in said pressure space at said large piston surface, said control valve varying pressure in said conduit bypass by spilling pressure medium so that a part pressure is respectively produced in said pressure space by partial spilling of pressure medium, which part pressure is kept approximately constant by corresponding activation of said control valve so that retention pressures which are very much smaller than adjusting pressures are set in the case of a non-transient position of said differential piston; and a pressure limiting valve arranged in a conduit connection between said pump and said pressure space at said large piston surface, said pressure limiting valve being subjected to pressure by said pump and being connected at an outlet end to said pressure space at said large piston surface.

8. A hydraulic setting device as defined in claim 7; and further comprising a proportional magnet, said control valve being a pressure limiting valve and actuated by said proportional magnet.

9. A hydraulic setting device as defined in claim 8, wherein said throttle device has a throttle with a fixed throttle cross-section and a variable by-pass device connected in parallel with said throttle.

10. A hydraulic setting device as defined in claim 9, wherein said by-pass device has a control spool which is actuated by said proportional magnet and which interacts with two control grooves, one of said control grooves being connected to a conduit connection upstream of said throttle while the other of said control grooves being connected to a conduit connection downstream of said throttle.

11. A hydraulic setting device as defined in claim 9, wherein said control valve is an electromagnetically activated 2/2-way valve.

12. A hydraulic setting device as defined in claim 7, wherein said pressure limiting valve has a valve element subjected to ambient pressure.

13. A hydraulic setting device as defined in claim 7, wherein said pressure limiting valve has a valve element which is freely guided and has a rear, said control having a set pressure acting on said rear of said valve element.

14. A hydraulic setting device as defined in claim 7; and further comprising a device for adjusting a cam shaft of an internal combustion engine relative to a crankshaft, said differential piston being connected with said device for adjusting the camshaft relative to the crankshaft.

* * * * *